US005716050A

United States Patent [19]

Jagosz

[11] Patent Number: 5,716,050

[45] **Date of Patent: *Feb. 10, 1998**

[54] BLACKJACK PLAY OPTION RESPONSE INDICATOR

[75] Inventor: Gerald J. Jagosz, Cedar, Mich.

[73] Assignee: Doris Incorporated, Cedar, Mich.

[ * ] Notice: The term of this patent shall not extend beyond the expiration date of Pat. No. 5,603,499.

[21] Appl. No.: 789,639

[22] Filed: Jan. 27, 1997

Related U.S. Application Data

[63] Continuation-in-part of Ser. No. 507,704, Jul. 26, 1995, Pat. No. 5,603,499.

[51] Int. Cl.[6] ..... A63F 1/06; G06C 3/00

[52] U.S. Cl. ..... 273/148 R; 273/142 R; 273/142 HA

[58] Field of Search ..... 273/148 R, 142 R, 273/142 H, 142 HA

[56] References Cited

U.S. PATENT DOCUMENTS

| | | | |
|---|---|---|---|
| 1,600,591 | 9/1926 | Johnston | 273/148 R |
| 1,714,839 | 5/1929 | Ashburn | 273/142 HA |
| 2,058,496 | 10/1936 | Paul | 273/148 R |
| 3,002,682 | 10/1961 | Scholtens | 273/148 R |
| 3,280,788 | 10/1966 | Robinson, Jr. | 273/148 R |
| 4,402,509 | 9/1983 | Dersher | 273/148 R |
| 4,721,309 | 1/1988 | Miesel | 273/148 R |
| 4,778,183 | 10/1988 | Luisi | 273/148 R |
| 5,189,285 | 2/1993 | Young, Jr. | 235/88 R |
| 5,603,499 | 2/1997 | Jagosz | 273/148 R |

FOREIGN PATENT DOCUMENTS

| | | | |
|---|---|---|---|
| 1196661 | 11/1985 | Canada | 273/148 R |
| 390763 | 8/1965 | Switzerland | 273/142 HA |

OTHER PUBLICATIONS

"The Blackjack Disc", Crimar Games, Inc. Dated Nov. 1986.

*Primary Examiner*—Benjamin H. Layno
*Attorney, Agent, or Firm*—Peter D. Keefe

[57] ABSTRACT

A blackjack play option response indicator which presents the 350 card combinations and the appropriate play option response for each card combination, composed of two disk rotatably connected to each other. The back disk has thereon a plurality of radially arranged rows of play option response indicia, wherein "B" designates "blackjack"; "H" designates "hit"; "S" designates "stand"; "D" designates "double down"; and "SP" designates "split". There are 350 play option response indicia which correspond to the recommended play option responses uniquely corresponding to each and every one of the 350 card combinations possible in blackjack. Adjacent the perimeter of the back disk, dealer's up card value indicia are provided thereon. The front disk is provided with a view port in the form of, preferably, four radially arranged slots for being selectively aligned with the aforementioned play option response indicia. Adjacent each slot is a player's card value indicia corresponding to all possible hands, which is either the total value of the player's hand, or each card in the event the cards include an ace or are a pair. The front disk further includes alignment indicia for selectively aligning a slot with the dealer's up card value indicia. In operation, the player finds the player's cards value indicia which corresponds best to his or her hand on the front disk. The player notes the value of the dealer's up card, and then rotates the front disk relative to the back disk so that the alignment indicia aligns with the dealers' up card value indicia on the back disk. Now, the appropriate play option response indicia will have appeared at the slot corresponding to the player's cards value indicia of the player's hand. The player then makes the play option so indicated.

17 Claims, 2 Drawing Sheets

BLACKJACK PLAY OPTION RESPONSE INDICATOR

CROSS-REFERENCE TO RELATED APPLICATIONS

The present application is a continuation-in-part application of application Ser. No. 08/507,704, filed Jul. 26, 1995, now U.S. Pat. No. 5,603,499.

BACKGROUND OF THE INVENTION

1. Field of the invention

The present invention relates to slide rules having relatively moving components and indicia provided thereon, wherein selective alignments of the indicia provide information for a user. More particularly, the present invention is a slide rule for indicating to a user the appropriate play that should be made by him or her given a predetermined situation encountered during a game of blackjack, the parameters associated with the situation being translated to the slide rule by the user selectively aligning indicia provided on the slide rule and then reading therefrom the appropriate play option response.

2. Description of the Related Art

The card game of blackjack is very well liked and has become a favorite in casinos. Blackjack is played with one or more decks of cards, each containing 52 conventional playing cards. The cards are assigned particular values which are dealt by a dealer to the players under rules of the game. The object of the game is simple: for a player, with values pre-assigned to his or her dealt cards, to get closer than the dealer to 21 without going over. There are a number of rules associated with the play of the game which are worthy of preliminary discussion herein.

Blackjack is played around a semicircular table, with usually seven player places. The dealer stands behind the table, facing the players. The table has a circular imprint at each place whereat the players place their bet in the form of chips, prior to card dealing.

As mentioned, the cards are those of conventional 52 card decks, with one or more decks being used. In this regard, an ace has the value of "1" or "11" at the election of the player, face card (Jack, Queen, King) have a value of "10" and the remaining card ("2" through "10") have their "pip" or number value. The card held by each player and the dealer are, respectively, added using these numerical rules to arrive at a total value. A hand is "soft" when the ace may be counted as either "1" or "11" without the total value going over "21"; a hand is "hard" when the ace can only be counted as a "1" without the total value going over "21"; a hand is "stiff" if the total value of the hand can go over "21" with the next dealt card; and a hand is "busted" if the total value has exceeded "21".

The dealer shuffles the cards and then commences to deal them, starting with the dealer's left-most player. All cards dealt to the players are usually dealt face up, and the first card dealt to the dealer is face down, while the second card dealt the dealer is dealt face up (the dealer's up card).

As mentioned, the object of the game is to win by the player having a total value closer to "21" than the dealer without going over. If the player goes over "21", the player loses or "busts". If the player and the dealer have the same total value, then the player does not win or loose, known as a "push". Accordingly, the dealer's up card is extremely important for the player in gauging play strategy to beat the dealer's hand.

If a player is dealt cards having a total value of "21", the player has a "blackjack" which is the ultimate hand, paying one and one-half times the player's bet. If the dealer gets a "blackjack" with his two dealt cards, he automatically wins and collects all bets, with two exceptions. The first exception is where the player puts up half-again more bet as "insurance" in the event the dealer's up card is an ace. If the dealer does not have a "blackjack", the dealer collects the player's insurance bet; but, if the dealer has a "blackjack", then the player retains all of his bet. The second exception is when a "push" occurs.

If the player has a "blackjack" and the dealer does not, the player wins and is paid immediately. Otherwise, after the two cards are dealt the players and the dealer, each player must decide what next to do to better enhance the chance of winning over the dealer's hand. What to do is based upon three criteria: the value of the two cards of the player and the value of the up card of the dealer. If a player is dealt a "blackjack" the play option response is obvious; otherwise, the player has 4 basic options of play response: the player can "split" (or "split pairs") wherein if the cards dealt are a pair, and if the player elects, the hand only be split into two hands provided the player plies another bet to cover the new hand; the player may "double down" wherein the player doubles his or her bet, but in so doing may take only one card (no additional cards will be given by the dealer); the player can "stand" wherein the player elects not to draw any additional cards (the player thus playing with only the original two dealt cards); or the player may "hit" wherein the player elects to take additional cards from the dealer in order to improve the total value of his or her hand.

With the foregoing principles of play in mind, it is apparent that the player must carefully consider what the most advantageous play option would be based upon the his or her cards and the dealer's up card. It has come to be recognized that there is a unique appropriate play option response for each of the possible 350 card combinations, which if the player chooses to so elect, his or her chances of winning are greatly improved. It is generally considered that the dealer has about a 6% advantage over a player. But, if the player makes play option response based carefully upon the appropriate one play option for each of the 350 card combinations, the player's chances of winning become equalized with the dealer. The 350 possible card combinations, and appropriate player play option responses for each, are recited in Table I, as follows:

TABLE I

| Card Combination | Player's Cards | Dealer's Up Card | Response |
|---|---|---|---|
| 1 | 5 | A | hit |
| 2 | 5 | 2 | hit |
| 3 | 5 | 3 | hit |
| 4 | 5 | 4 | hit |
| 5 | 5 | 5 | hit |
| 6 | 5 | 6 | hit |
| 7 | 5 | 7 | hit |
| 8 | 5 | 8 | hit |
| 9 | 5 | 9 | hit |
| 10 | 5 | 10 | hit |
| 11 | 6 | A | hit |
| 12 | 6 | 2 | hit |
| 13 | 6 | 3 | hit |
| 14 | 6 | 4 | hit |
| 15 | 6 | 5 | hit |
| 16 | 6 | 6 | hit |
| 17 | 6 | 7 | hit |
| 18 | 6 | 8 | hit |
| 19 | 6 | 9 | hit |

TABLE I-continued

| Card Combination | Player's Cards | Dealer's Up Card | Response |
|---|---|---|---|
| 20 | 6 | 10 | hit |
| 21 | 7 | A | hit |
| 22 | 7 | 2 | hit |
| 23 | 7 | 3 | hit |
| 24 | 7 | 4 | hit |
| 25 | 7 | 5 | hit |
| 26 | 7 | 6 | hit |
| 27 | 7 | 7 | hit |
| 28 | 7 | 8 | hit |
| 39 | 7 | 9 | hit |
| 30 | 7 | 10 | hit |
| 31 | 8 | A | hit |
| 32 | 8 | 2 | hit |
| 33 | 8 | 3 | hit |
| 34 | 8 | 4 | hit |
| 35 | 8 | 5 | hit |
| 36 | 8 | 6 | hit |
| 37 | 8 | 7 | hit |
| 38 | 8 | 8 | hit |
| 39 | 8 | 9 | hit |
| 40 | 8 | 10 | hit |
| 41 | 9 | A | hit |
| 42 | 9 | 2 | hit |
| 43 | 9 | 3 | double down |
| 44 | 9 | 4 | double down |
| 45 | 9 | 5 | double down |
| 46 | 9 | 6 | double down |
| 47 | 9 | 7 | hit |
| 48 | 9 | 8 | hit |
| 49 | 9 | 9 | hit |
| 50 | 9 | 10 | hit |
| 51 | 10 | A | hit |
| 52 | 10 | 2 | double down |
| 53 | 10 | 3 | double down |
| 54 | 10 | 4 | double down |
| 55 | 10 | 5 | double down |
| 56 | 10 | 6 | double down |
| 57 | 10 | 7 | double down |
| 58 | 10 | 8 | double down |
| 59 | 10 | 9 | double down |
| 60 | 10 | 10 | hit |
| 61 | 11 | A | hit |
| 62 | 11 | 2 | double down |
| 63 | 11 | 3 | double down |
| 64 | 11 | 4 | double down |
| 65 | 11 | 5 | double down |
| 66 | 11 | 6 | double down |
| 67 | 11 | 7 | double down |
| 68 | 11 | 8 | double down |
| 69 | 11 | 9 | double down |
| 70 | 11 | 10 | double down |
| 71 | 12 | A | hit |
| 72 | 12 | 2 | hit |
| 73 | 12 | 3 | hit |
| 74 | 12 | 4 | stand |
| 75 | 12 | 5 | stand |
| 76 | 12 | 6 | stand |
| 77 | 12 | 7 | hit |
| 78 | 12 | 8 | hit |
| 79 | 12 | 9 | hit |
| 80 | 12 | 10 | hit |
| 81 | 13 | A | hit |
| 82 | 13 | 2 | stand |
| 83 | 13 | 3 | stand |
| 84 | 13 | 4 | stand |
| 85 | 13 | 5 | stand |
| 86 | 13 | 6 | stand |
| 87 | 13 | 7 | hit |
| 88 | 13 | 8 | hit |
| 89 | 13 | 9 | hit |
| 90 | 13 | 10 | hit |
| 91 | 14 | A | hit |
| 92 | 14 | 2 | stand |
| 93 | 14 | 3 | stand |
| 94 | 14 | 4 | stand |
| 95 | 14 | 5 | stand |
| 96 | 14 | 6 | stand |

TABLE I-continued

| Card Combination | Player's Cards | Dealer's Up Card | Response |
|---|---|---|---|
| 97 | 14 | 7 | hit |
| 98 | 14 | 8 | hit |
| 99 | 14 | 9 | hit |
| 100 | 14 | 10 | hit |
| 101 | 15 | A | hit |
| 102 | 15 | 2 | stand |
| 103 | 15 | 3 | stand |
| 104 | 15 | 4 | stand |
| 105 | 15 | 5 | stand |
| 106 | 15 | 6 | stand |
| 107 | 15 | 7 | hit |
| 108 | 15 | 8 | hit |
| 109 | 15 | 9 | hit |
| 110 | 15 | 10 | hit |
| 111 | 16 | A | hit |
| 112 | 16 | 2 | stand |
| 113 | 16 | 3 | stand |
| 114 | 16 | 4 | stand |
| 115 | 16 | 5 | stand |
| 116 | 16 | 6 | stand |
| 117 | 16 | 7 | hit |
| 118 | 16 | 8 | hit |
| 119 | 16 | 9 | hit |
| 120 | 16 | 10 | hit |
| 121 | 17 | A | stand |
| 122 | 17 | 2 | stand |
| 123 | 17 | 3 | stand |
| 124 | 17 | 4 | stand |
| 125 | 17 | 5 | stand |
| 126 | 17 | 6 | stand |
| 127 | 17 | 7 | stand |
| 128 | 17 | 8 | stand |
| 129 | 17 | 9 | stand |
| 130 | 17 | 10 | stand |
| 131 | 18 | A | stand |
| 132 | 18 | 2 | stand |
| 133 | 18 | 3 | stand |
| 134 | 18 | 4 | stand |
| 135 | 18 | 5 | stand |
| 136 | 18 | 6 | stand |
| 137 | 18 | 7 | stand |
| 138 | 18 | 8 | stand |
| 139 | 18 | 9 | stand |
| 140 | 18 | 10 | stand |
| 141 | 19 | A | stand |
| 142 | 19 | 2 | stand |
| 143 | 19 | 3 | stand |
| 144 | 19 | 4 | stand |
| 145 | 19 | 5 | stand |
| 146 | 19 | 6 | stand |
| 147 | 19 | 7 | stand |
| 148 | 19 | 8 | stand |
| 149 | 19 | 9 | stand |
| 150 | 19 | 10 | stand |
| 151 | 20 | A | stand |
| 152 | 20 | 2 | stand |
| 153 | 20 | 3 | stand |
| 154 | 20 | 4 | stand |
| 155 | 20 | 5 | stand |
| 156 | 20 | 6 | stand |
| 157 | 20 | 7 | stand |
| 158 | 20 | 8 | stand |
| 159 | 20 | 9 | stand |
| 160 | 20 | 10 | stand |
| 161 | A-A | A | split |
| 162 | A-A | 2 | split |
| 163 | A-A | 3 | split |
| 164 | A-A | 4 | split |
| 165 | A-A | 5 | split |
| 166 | A-A | 6 | split |
| 167 | A-A | 7 | split |
| 168 | A-A | 8 | split |
| 169 | A-A | 9 | split |
| 170 | A-A | 10 | split |
| 171 | A-2 | A | hit |
| 172 | A-2 | 2 | hit |
| 173 | A-2 | 3 | hit |

TABLE I-continued

| Card Combination | Player's Cards | Dealer's Up Card | Response |
|---|---|---|---|
| 174 | A-2 | 4 | hit |
| 175 | A-2 | 5 | double down |
| 176 | A-2 | 6 | double down |
| 177 | A-2 | 7 | hit |
| 178 | A-2 | 8 | hit |
| 179 | A-2 | 9 | hit |
| 180 | A-2 | 10 | hit |
| 181 | A-3 | A | hit |
| 182 | A-3 | 2 | hit |
| 183 | A-3 | 3 | hit |
| 184 | A-3 | 4 | hit |
| 185 | A-3 | 5 | double down |
| 186 | A-3 | 6 | double down |
| 187 | A-3 | 7 | hit |
| 188 | A-3 | 8 | hit |
| 189 | A-3 | 9 | hit |
| 190 | A-3 | 10 | hit |
| 191 | A-4 | A | hit |
| 192 | A-4 | 2 | hit |
| 193 | A-4 | 3 | hit |
| 194 | A-4 | 4 | double down |
| 195 | A-4 | 5 | double down |
| 196 | A-4 | 6 | double down |
| 197 | A-4 | 7 | hit |
| 198 | A-4 | 8 | hit |
| 199 | A-4 | 9 | hit |
| 200 | A-4 | 10 | hit |
| 201 | A-5 | A | hit |
| 202 | A-5 | 2 | hit |
| 203 | A-5 | 3 | hit |
| 204 | A-5 | 4 | double down |
| 205 | A-5 | 5 | double down |
| 206 | A-5 | 6 | double down |
| 207 | A-5 | 7 | hit |
| 208 | A-5 | 8 | hit |
| 209 | A-5 | 9 | hit |
| 210 | A-5 | 10 | hit |
| 211 | A-6 | A | hit |
| 212 | A-6 | 2 | hit |
| 213 | A-6 | 3 | double down |
| 214 | A-6 | 4 | double down |
| 215 | A-6 | 5 | double down |
| 216 | A-6 | 6 | double down |
| 217 | A-6 | 7 | hit |
| 218 | A-6 | 8 | hit |
| 219 | A-6 | 9 | hit |
| 220 | A-6 | 10 | hit |
| 221 | A-7 | A | hit |
| 222 | A-7 | 2 | stand |
| 223 | A-7 | 3 | double down |
| 224 | A-7 | 4 | double down |
| 225 | A-7 | 5 | double down |
| 226 | A-7 | 6 | double down |
| 227 | A-7 | 7 | stand |
| 228 | A-7 | 8 | stand |
| 229 | A-7 | 9 | hit |
| 230 | A-7 | 10 | hit |
| 231 | A-8 | A | stand |
| 232 | A-8 | 2 | stand |
| 233 | A-8 | 3 | stand |
| 234 | A-8 | 4 | stand |
| 235 | A-8 | 5 | stand |
| 236 | A-8 | 6 | stand |
| 237 | A-8 | 7 | stand |
| 238 | A-8 | 8 | stand |
| 239 | A-8 | 9 | stand |
| 240 | A-8 | 10 | stand |
| 241 | A-9 | A | stand |
| 242 | A-9 | 2 | stand |
| 243 | A-9 | 3 | stand |
| 244 | A-9 | 4 | stand |
| 245 | A-9 | 5 | stand |
| 246 | A-9 | 6 | stand |
| 247 | A-9 | 7 | stand |
| 248 | A-9 | 8 | stand |
| 259 | A-9 | 9 | stand |
| 260 | A-9 | 10 | stand |

TABLE I-continued

| Card Combination | Player's Cards | Dealer's Up Card | Response |
|---|---|---|---|
| 251 | A-10 | A | blackjack |
| 252 | A-10 | 2 | blackjack |
| 253 | A-10 | 3 | blackjack |
| 254 | A-10 | 4 | blackjack |
| 255 | A-10 | 5 | blackjack |
| 256 | A-10 | 6 | blackjack |
| 257 | A-10 | 7 | blackjack |
| 258 | A-10 | 8 | blackjack |
| 259 | A-10 | 9 | blackjack |
| 260 | A-10 | 10 | blackjack |
| 261 | 2-2 | A | hit |
| 262 | 2-2 | 2 | hit |
| 263 | 2-2 | 3 | hit |
| 264 | 2-2 | 4 | split |
| 265 | 2-2 | 5 | split |
| 266 | 2-2 | 6 | split |
| 267 | 2-2 | 7 | split |
| 268 | 2-2 | 8 | hit |
| 269 | 2-2 | 9 | hit |
| 270 | 2-2 | 10 | hit |
| 271 | 3-3 | A | hit |
| 272 | 3-3 | 2 | hit |
| 273 | 3-3 | 3 | hit |
| 274 | 3-3 | 4 | split |
| 275 | 3-3 | 5 | split |
| 276 | 3-3 | 6 | split |
| 277 | 3-3 | 7 | split |
| 278 | 3-3 | 8 | hit |
| 279 | 3-3 | 9 | hit |
| 290 | 3-3 | 10 | hit |
| 281 | 4-4 | A | hit |
| 282 | 4-4 | 2 | hit |
| 283 | 4-4 | 3 | hit |
| 284 | 4-4 | 4 | hit |
| 285 | 4-4 | 5 | hit |
| 286 | 4-4 | 6 | hit |
| 287 | 4-4 | 7 | hit |
| 288 | 4-4 | 8 | hit |
| 289 | 4-4 | 9 | hit |
| 2901 | 4-4 | 10 | hit |
| 291 | 5-5 | A | hit |
| 292 | 5-5 | 2 | double down |
| 293 | 5-5 | 3 | double down |
| 294 | 5-5 | 4 | double down |
| 295 | 5-5 | 5 | double down |
| 296 | 5-5 | 6 | double down |
| 297 | 5-5 | 7 | double down |
| 298 | 5-5 | 8 | double down |
| 299 | 5-5 | 9 | double down |
| 300 | 5-5 | 10 | hit |
| 301 | 6-6 | A | hit |
| 302 | 6-6 | 2 | hit |
| 303 | 6-6 | 3 | split |
| 304 | 6-6 | 4 | split |
| 305 | 6-6 | 5 | split |
| 306 | 6-6 | 6 | split |
| 307 | 6-6 | 7 | hit |
| 308 | 6-6 | 8 | hit |
| 309 | 6-6 | 9 | hit |
| 310 | 6-6 | 10 | hit |
| 311 | 7-7 | A | hit |
| 312 | 7-7 | 2 | split |
| 313 | 7-7 | 3 | split |
| 314 | 7-7 | 4 | split |
| 315 | 7-7 | 5 | split |
| 316 | 7-7 | 6 | split |
| 317 | 7-7 | 7 | split |
| 318 | 7-7 | 8 | hit |
| 319 | 7-7 | 9 | hit |
| 320 | 7-7 | 10 | hit |
| 321 | 8-8 | A | split |
| 322 | 8-8 | 2 | split |
| 323 | 8-8 | 3 | split |
| 324 | 8-8 | 4 | split |
| 325 | 8-8 | 5 | split |
| 326 | 8-8 | 6 | split |
| 327 | 8-8 | 7 | split |

TABLE I-continued

| Card Combination | Player's Cards | Dealer's Up Card | Response |
|---|---|---|---|
| 328 | 8-8 | 8 | split |
| 329 | 8-8 | 9 | split |
| 330 | 8-8 | 10 | split |
| 331 | 9-9 | A | stand |
| 332 | 9-9 | 2 | split |
| 333 | 9-9 | 3 | split |
| 334 | 9-9 | 4 | split |
| 335 | 9-9 | 5 | split |
| 336 | 9-9 | 6 | split |
| 337 | 9-9 | 7 | stand |
| 338 | 9-9 | 8 | split |
| 339 | 9-9 | 9 | split |
| 340 | 9-9 | 10 | stand |
| 341 | 10-10 | A | stand |
| 342 | 10-10 | 2 | stand |
| 343 | 10-10 | 3 | stand |
| 344 | 10-10 | 4 | stand |
| 345 | 10-10 | 5 | stand |
| 346 | 10-10 | 6 | stand |
| 347 | 10-10 | 7 | stand |
| 348 | 10-10 | 8 | stand |
| 249 | 10-10 | 9 | stand |
| 350 | 10-10 | 10 | stand |

In Table I the total value of a player's hand is indicated by a single number, unless an ace (indicated by a "A") or a pair is involved, whereupon each of the card values are indicated separately for each hand (each value being separated by a hyphen). The responses adjusted in Table I may be changed as the ever increasing body of knowledge of the game of blackjack would from time to time best recommend.

It will be immediately deduced from the foregoing, that it is rather difficult for an average player to memorize these appropriate plays, and in the heat and excitement of a game, even the most accomplished player can experience a memory block at a crucial time.

Accordingly, what is needed in the art is a device which presents the 350 card combinations and the appropriate play option response for each card combination in a compact configuration, wherein and the appropriate play option response is swiftly accessible to a player so that the player can confidently play blackjack with a heightened expectancy of winning.

SUMMARY OF THE INVENTION

The present invention is a blackjack play option response indicator which presents the 350 card combinations and the appropriate play option response for each card combination in a compact, easily operated slide rule configuration, wherein the appropriate play option response for each card combination is swiftly accessible to a player so that the player can confidently play blackjack with a heightened expectancy of winning.

The blackjack play option response indicator according to the present invention is composed generally of two disks which are rotatably connected to each other, such as by a rivet. One disk is a back disk and the other disk is a front disk. A preferred disk material is styrene plastic.

The back disk has provided thereon a plurality of radially arranged rows of play option response indicia, wherein "B" designates "blackjack"; "H" designates "hit"; "S" designates "stand"; "D" designates "double down"; and "SP" designates "split". There are 350 play option response indicia which correspond to the recommended play option responses uniquely corresponding to each and every one of the 350 card combinations possible in blackjack (see Table I). Adjacent the perimeter of the back disk, dealer's up card value indicia are provided thereon, wherein each and every possible dealer's up card value is regularly spaced (every 36 degrees) and arranged in increasing numerical progression.

The front disk is provided with a viewing port, preferably in the form of four radially arranged slots, for being selectively aligned with the aforementioned play option response indicia adjacent the viewing port are player's cards value indicia, which are each either the total value of the player's hand, or each card in the event the cards include an ace or are a pair. There are 35 player's cards value indicia, each corresponding uniquely to one of the 35 possible hands a player may have during a game of blackjack. The front disk further includes alignment indicia for selectively aligning a view port corresponding to the hand possessed by the player with the dealer's up card value to thereby align a particular row of play option response indicia with the view port.

In operation, the player and the dealer are each dealt their cards. The dealer has one up card for which the value is known to the player. If the player does not have a blackjack, the player must make a play decision, ie., either hit, stand, split or double down. The appropriate decision is made as follows using the blackjack play option response indicator according to the present invention. The player finds the player's cards value indicia which corresponds best to his or her hand (ie., "3—3" rather than "6" in the event the player has a pair, or "A–5" rather than "6" or "16" in the event the player has an "ace" and a "5") on the front disk. The player then notes the alignment indicia corresponding to that view port. The player next notes the value of the dealer's up card, and then rotates the front disk relative to the back disk so that the alignment indicia aligns with the dealer's up card value indicia on the back disk, Now, appropriate play option response indicia will automatically have appeared in the view port, and in particular the appropriate play option response indicia will have appeared adjacent the corresponding player's card value indicia of the player's hand. The player then makes the play option so indicated.

Accordingly, it is an object of the present invention to provide a blackjack play option response indicator which indicates an appropriate play option for each of the 350 card combinations of the game.

It is an additional object of the present invention to provide a blackjack play option response indicator which indicates an appropriate play option for each of the 350 card combinations of the game, wherein the play option is easily and reliably findable.

It is another object of the present invention to provide s blackjack play option response indicator which indicates an appropriate play option for each of the 350 card combinations of the game, wherein a slide rule format is provided therefor which is compact, easily read and easily used.

These, and additional objects, advantages, features and benefits of the present invention will become apparent from the following specification.

DETAILED DESCRIPTION OF THE PREFERRED EMBODIMENT

Figure 1:
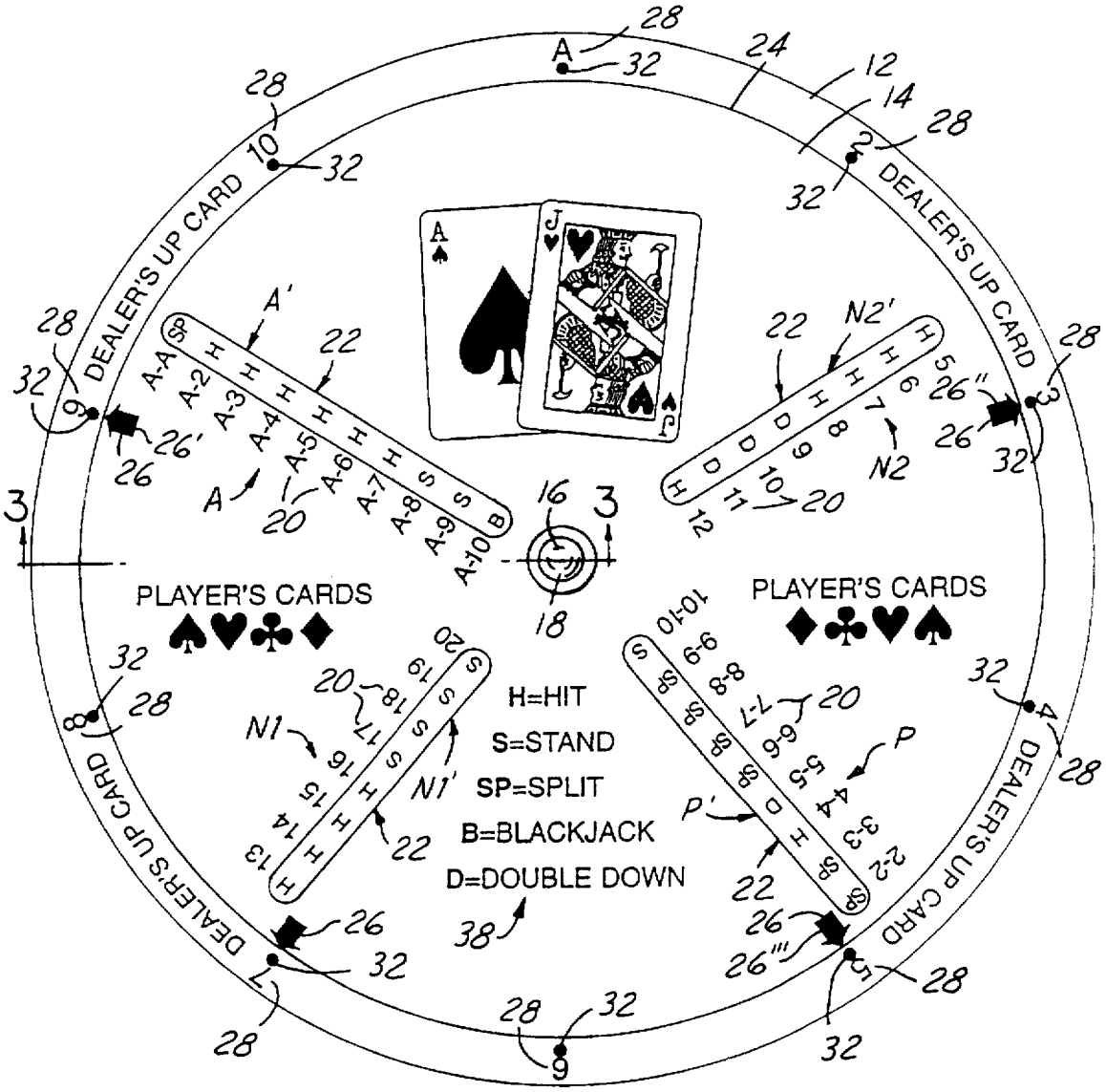
FIG. 1 is a plan view of the blackjack play option response indicator according to the present invention.
Figure 3:
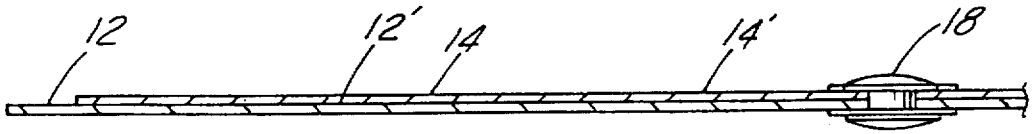
FIG. 3 is a partly broken-away side view of the blackjack play option response indicator according to the present invention.

As can be discerned by reference to FIG. 1, the blackjack play option response indicator 10 according to the present invention is composed of two rotatably interconnected disks: a back disk 12 having a back disk face 12' and a front disk 14 having a front disk face 14', wherein the back disk face faces toward the front disk and the front disk face faces away from the back disk. The back and front disks 12, 14 are superposed and connected at their mutual centers 16, such as by a rivet 18 or another conventional interconnection mechanism which permits relative rotation therebetween. A preferred material of composition of the back and front disks 12, 14 is a styrene plastic, however, other generally stiff sheet materials can be substituted, such as a metal, paper or cardboard composition. While the composition of the front and back disks is preferred to be opaque, at least a portion thereof may be light transmissible. A preferred thickness for the front and back disks is about 0.002 inch each where styrene plastic is used in their construction. In the preferred embodiment, the back disk 12 has a larger diameter than that of the front disk 14, for example, a preferred diameter of the rear disk is 4 inches, while that of the front disk is 3.65625 inches. The selected composition and sizes of the front and back disks may be varied from that specified above.

As recited hereinabove in Table I, there are 350 preferred card combinations possible in blackjack, and that for each of those card combinations, there is one particular appropriate player play option response. As also recounted in Table I, these player play option responses are 5 in number: "blackjack" wherein the total value of the cards equals exactly "21" (requiring no affirmative response from the player since this is automatically a winning play option); "split" (that is, "split pairs") wherein if the cards dealt are a pair, and if the player elects, the hand may be split into two hands provided the player places another bet to cover the new hand; "double down" wherein the player doubles his or her bet, but in so doing may draw only one additional card (no additional cards will be given by the dealer); "stand" wherein the player elects not to draw any additional card (the player thus playing with only the original two dealt cards); and "hit" wherein the player elects to draw additional cards from the dealer in order to improve the total value of his or her hand. Accordingly, the blackjack play option response indicator 10 according to the present invention has provision for selectively organizing the 350 preferred card combinations (10 possible dealer's up card values times 35 possible player's cards values), and the corresponding 350 player play option responses so that the player immediately obtains the unique play option response that corresponds to the particular player play situation based upon the value of the cards of his or her hand and the dealer's up card To commence detail exposition of the structure and function of the blackjack play option response indicator 10 according to the present invention, first examined will be the organization of the player's cards value indicia which are depicted on the front disk face 14' of the front disk 14, per FIG. 1.

The 35 player's cards values include: ten different values wherein at least one card held in the player's hand is an ace; nine different pair values; and sixteen different total values (for player's hands other than those having an ace/pair). These player's cards values are indicated as player's cards value indicia 20 provided on the front disk face 14' of the front disk 14 which are arranged into four radically oriented rows: first player's cards value indicia row A includes all ace combinations in numerically descending order from the center 16, wherein the player's cards value indicia is here indicated by an "A" (wherein "A" indicates either the value "1" or "11") with its companion card indicated by an "A" or else its pip number; second player's cards value indicia row P includes all pair combinations in numerically descending order from the center, wherein the player's cards value indicia is here the pip value for each card of the player's hand is indicated separately; third player's cards value indicia row N1 includes the total values from "20" through "13" in descending order from the center, wherein the player's card value indicia is a single number reflective of the player's cards; and finally fourth player's cards value indicia row N2 includes the total values from "12" through "5" in descending order from the center, wherein the player's cards value indicia is a single number reflective of the player's cards.

In order to provide viewing access to the play option response indicia (provided on the back disk 12) appropriate for each particular player's cards value indicia 20, a viewing port 22 is provided laterally adjacent thereto. It is preferred for the viewing port 22 to be in the form of first, second, third and fourth slots A', P', N1' and N2' coextensively corresponding to the first, second, third and fourth player's cards value indicia rows A, P, N1 and N2. Preferably, the angular separation of the first, second third and fourth slots A', P', N1', N2' is as follows: the angular separation between the first and fourth slots A' and N2' is one hundred-seventeen degrees; the angular separation between the fourth and second slots N2' and P' is eighty-one degrees; the angular separation between the second and third slots P' and N1' is eighty-one degrees; and the angular separation between the third and first slots N1' and A' is eighty-one degrees.

On the front disk face 14' adjacent the perimeter 24 of the front disk 14 is provided an alignment indicia 26 uniquely for each of the first, second, third and fourth player's cards value indicia rows A, P, N1, N2, of player's cards value indicia 20. The alignment indicia 26 are preferably arrows that point to the periphery 24 and are used to selectively align the front disk 14 with the back disk 12 for providing the appropriate player's play option response for a selected play situation involving the cards value of the player's hand and the value of the dealer's up card, in a manner which will become dear momentarily.

Figure 2:
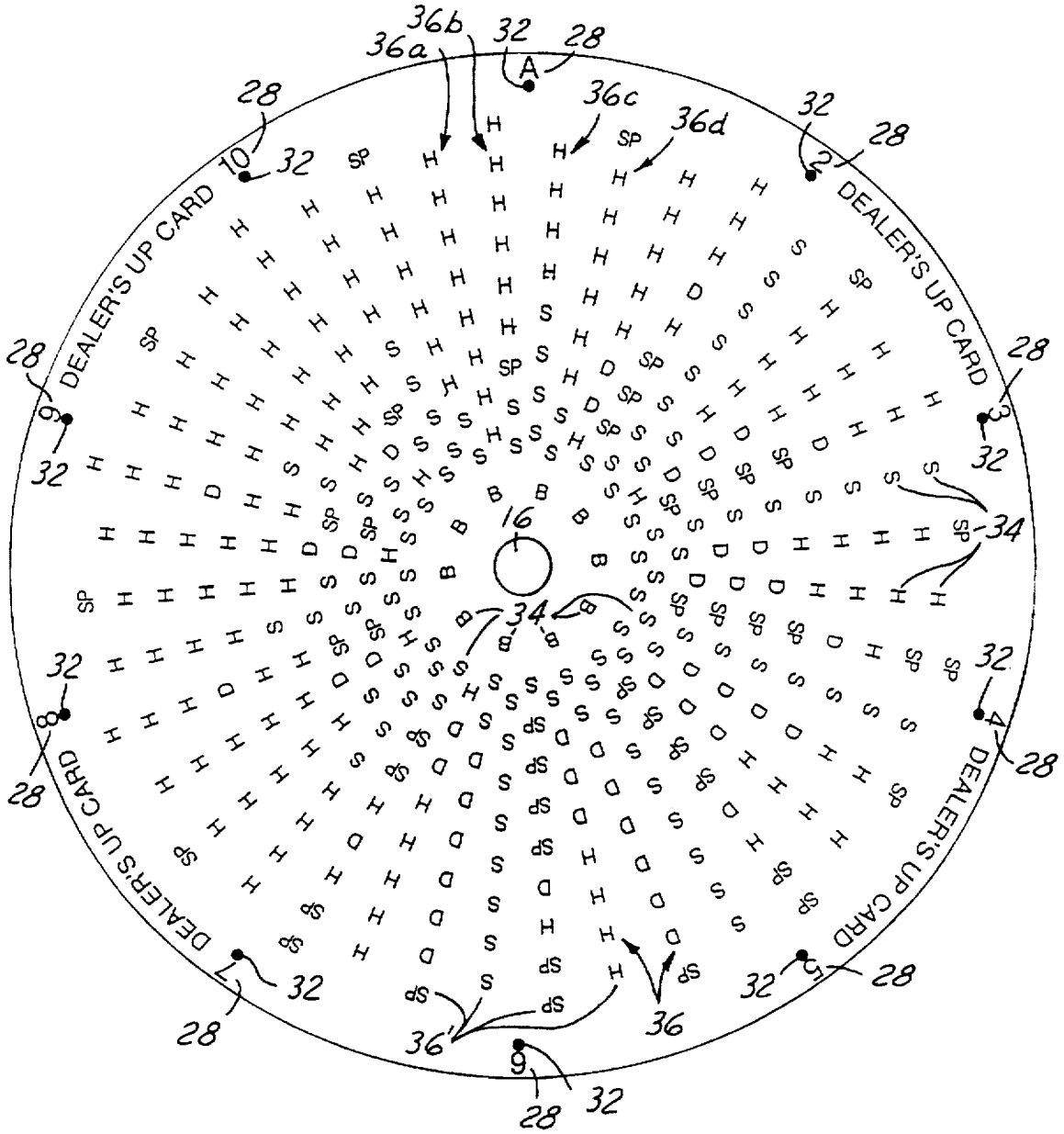
FIG. 2 is a plan view of the back disk of the blackjack play option response indicator according to the present invention.

Now to further detail the structure and function of the blackjack play option response indicator 10 according to the present invention, next examined will be the organization of the play option responses which are depicted on the back disk 12, per FIG. 2.

Firstly, as mentioned hereinabove, there are 10 possible dealer's up card values. These dealer's up card values are: "ace" and "2" through "10", wherein "10"0 includes a pip value or the numerical value for any of the three face cards (Jack, Queen and King). These are provided on back disk face 12' of the back disk 12 as dealer's up card value indicia 28 adjacent the perimeter 30 thereof, in regularly spaced locations (every thirty-six degrees) and arranged in sequential numerical order (the "ace" being in order as either a "1" value or an "11" value). In operation, the dealer's up card value indicia 28 are selectively aligned with the aforementioned alignment indicia 26, preferably via the aid of positioning indicia 32 (shown in the preferred fore of a dot) which adjoin, and are radially centered with respect to, the dealer's up card value indicia, the operational features associated therewith being explained momentarily.

With regard to the 350 preferred play option responses, these are provided on the back disk face 12' of the back disk 12 in the fore of play option response indicia 34 arranged in forty play option response indicia rows 36 (mutually angularly spaced nine degrees apart). In this regard, there are ten sets 36' of four sequentially adjacent play option response indicia rows 36 associated with, and centered on, each of the 10 dealer's up card value indicia 28, wherein each set of four play option response indicia rows thereof corresponds, respectively, to one of the first, second, third and fourth slots A', P', N1', N2' of the viewing port 22. In this regard further, the play option response indicia 34 indicate the appropriate play option response (as recited in Table I hereinabove) for each of the 35 player's cards values possible for each dealer's up card value. The spacing of the play option response indicia 34 corresponds to the spacing of the view port 22 so that the play option response indicia is visible therethrough when they are respectively aligned.

A detailing of the arrangement of set 36' of the play option response indicia row 36 for dealer's up card value depicted as "Ace" in FIGS. 1 and 2 will now be undertaken, it being understood that this exemplification of the methodology of arrangement of the play option response indicia rows thereof applies analogously to the remaining dealer's up card values. In this regard, the following abbreviations are used for the five play option responses: "H" for "hit"; "S" for "stand"; "B" for "blackjack"; "SP" for "split"; and "D" for "double down". In this regard, it is preferable to recite the meanings of the abbreviations on the front disk face of the front disk 14, as shown at 38 in FIG. 1.

A first play option response indicia row **36*a* provides the play option responses appropriate to each of the player's card indicia 20** of the fourth player's cards value indicia row N2 when the dealer's up card is an "ace", as above recounted hereinabove as card combinations 1, 11, 21, 31, 41, 51, 61, and 71 in Table I.

A second play option response indicia row **36*b*** provides the play option responses appropriate to each of the player's cards value indicia 20 of the second player's cards value indicia row P when the dealer's up card is an "ace", as above recounted hereinabove as card combinations 261, 271, 281, 291, 301, 311, 321, 331 and 341 in Table I.

A third play option response indicia row **36*c*** provides the play option responses appropriate to each of the player's cards value indicia 20 of the third player's cards value indicia row N1 when the dealer's up card is an "ace", as above recounted hereinabove as card combinations 81, 91, 101, 111, 121, 131, 141, and 151 in Table I.

Finally, a fourth play option response indicia row **36*d*** provides the play option responses appropriate to each of the player's cards value indicia 20 of the first player's cards value indicia row A when the dealer's up card is an "ace", as above recounted hereinabove as card combinations 161, 171, 181, 191, 201, 211, 221, 231, 241, and 251 in Table I.

The arrangement of the play option rows 36 is shown by FIG. 2 and is arranged analogous to the foregoing description with respect to "Ace" for each of to the remaining dealer's up card value indicia, which, for the sake of brevity, need not be recounted herein for those of ordinary skill in the art to understand and practice the present invention.

Operation of the player play option response indicator 10 according to the present invention will now be described, with particular reference now being a directed to FIG. 1.

In operation, the player and the dealer are each dealt their cards. The dealer has one up card for which the value is known to the player. If the player does not have a blackjack (wherein the play option decision is automatic), the player must make a play decision, ie., either hit, stand, split or double down. The player looks at his or her cards and finds the player's cards value indicia 20 which corresponds best to his or her hand. In so doing, if the player's hand has an ace, player's cards value indicia row A is first looked at to find the player's hand; if the player's hand has a pair, then the player's cards value indicia row P is first looked at to find the player's hand. For example, a player's hand having a pair of "3—3" is found in player's cards value indicia row P, rather than "6" in player's cards value indicia row N2 on the front disk 14; and a player's hand having an ace of "A–5" is found in player's cards value indicia row A, rather than "6" or "16" in player's cards value indicia rows N1, N2 on the front disk. The player then notes the alignment indicia 26 corresponding thereto. The player next notes the value of the dealer's up card and finds the corresponding dealer's up card value indicia 28 on the back disk 12. The player then rotates the front disk relative to the back disk so that the alignment indicia aligns with the dealer's up card value indicia (or more particularly the positioning indicia 32 thereof when present) on the back disk. Now, the play option response indicia 34 will automatically have appeared in the view port 22, and in particular the appropriate play option response indicia will have appeared at one of the first, second, third or fourth slots A', P', N1', N2' which corresponds to the particular player's cards value indicia of the player's hand. The player then responds by making the play option response so indicated Now consider three examples of play situations which happen to be shown in FIG. 1.

Consider first that the dealer has an up card of value "9", while the player has two cards having the values of "ace" and "6". The player then notices his or her hand is indicated (became of the player's hand contains an ace) in the first player's cards value indicia row A. The player rotates the arrow associated therewith 26' to the dealer's up card value indicia 28 indicated by "9". Now the player notices that at player's cards value indicia 20 "A–6", visible through the view port 22, specifically first slot A', laterally adjacent thereto is the play option response indicia 34 "H", which, per the abbreviation meaning therefor, means the player should respond to the play situation by hitting. This play option is indicated by card combination 219 in Table I.

Consider next that the dealer has an up card of value "3", while the player has two cards having the values of "2" and "7", for a total value of "9". The player then notices his or her hand is indicated in the fourth player's cards value indicia row N2. The player rotates the alignment indicia associated therewith 26" to the dealer's up card value indicia 28 indicated by "3". Now the player notices that at player's cards value indicia 20 "9", visible through the view port 22, specifically fourth slot N2', laterally adjacent thereto is the play option response indicia 34 "D", which, per the abbreviation meaning therefor, means the player should respond to the play situation by doubling down. This is play option is indicated by card combination 43 in Table I.

Consider last that the dealer has an up card of value "5", while the player has two cards having the values of "8" and "8". The player then notices his or her hand is indicated (because the player's hand contains a pair) in the second player's cards value indicia row P. The player rotates the alignment indicia associated therewith 26'" to the dealer's up card value indicia 28 indicated by "5". Now the player notices that at player's cards value indicia 20 "8—8", visible through the view port 22, specifically second slot P', literally adjacent thereto is the play option response indicia 34 "SP", which, per the abbreviation meaning therefor, means the player should respond to the play situation by splitting. This is play option is indicated by card combination 325 in Table I.

It is to be understood that the exact number of card combinations and the appropriate play option responses therefor may be varied, without departing from the basic teaching of the present invention. Also, while each of the first, second, third and fourth player's cards indicia rows A, P, N1, N2 are shown simultaneously in alignment in FIG. 1, via their respective alignment indicia, with a dealer's up card value indicia, this is not a requirement.

Further, while the player's cards value indicia are divided among four rows, this is not necessary, although it is certainly preferred for the sake of providing a compact size for the blackjack play option response indicator according to the present invention. For example, there could be two rows of player's cards value indicia, wherein ace containing hands are sequentially arranged and then (at either end thereof) hands having pairs are sequentially arranged; while all other hands are arranged in a single row (rather than two as depicted in FIG. 1). Of course, the view port would be correspondingly arranged and the number of play option response indicia would coincide with the number of player's cards value indicia rows, and correspondingly spaced and arranged. Further in this regard, the indicia referred to hereinabove may be located on the respective front and back disks other than as shown in the Drawing, provided the mutual interaction of the indicia is as hereinabove described for providing the appropriate play option for each play situation.

It will be further understood that any of the indicia referred to hereinabove may be provided on the front and back disks by any conventional way, such as for example by printing or by a decal. It should also be noted that a person having ordinary skill in the art can provide a transparent front disk that has been rendered generally opaque (such as by printing or a decal applied thereto) but has transparent areas in place of the aforementioned first, second, third and fourth slots (be they continuously open as shown or in some manner subdivided), either of which being referred to generically as view ports, and wherein the Drawing is to be interpreted as generically showing view ports. Further still, the indicia referred to hereinabove is preferred, but not required, to have color coding for facilitating easy reference thereto. For example, the play option responses may be color coded as follows: "H" in red; "D" in black; "S" in green; and "SP" in yellow.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A blackjack play option response indicator, comprising:

a front disk having a front disk face, a front disk center and a front disk periphery, said front disk having a plurality of player's cards value indicia placed in a predetermined arrangement and a predetermined sequence on said front disk face, said front disk having view port means for seeing through said front disk adjacent each player's cards value indicia, said front disk having alignment indicia on said front disk face, said alignment indicia being selectively associated with said player's cards value indicia;

a rear disk having a rear disk face, a rear disk center and a rear disk periphery, said rear disk being superposed said front disk wherein said rear disk face faces toward said front disk and said front disk face faces away from said rear disk, said rear disk having a plurality of play option response indicia arranged in a predetermined arrangement and a predetermined sequence on said rear disk face for selectively appearing in said view port means in said front disk, said rear disk having dealer's up card value indicia arranged in a predetermined pattern on said rear disk face; and means for rotatably interconnecting said front disk center with said rear disk center;

wherein a user who is playing a game of blackjack locates a player's cards value indicia corresponding to cards values of a hand held by the user, rotates a selected alignment indicia associated therewith into alignment with a dealer's up card value indicia corresponding to an up card value held by a dealer who is dealing the game of blackjack, then reads the play option response indicia through said view port means adjacent the selected player's cards value indicia to thereby ascertain what appropriate play option is to be played by the user;

wherein said plurality of cards value indicia are arranged in a preselected number of player's cards value indicia rows, each player's cards value indicia row being oriented radially with respect to said front disk center; wherein said view port means is arranged laterally adjacent each player's cards value indicia; and wherein said plurality of play option response indicia are arranged in said preselected number of play option response indicia rows with respect to each said dealer's up card value indicia, each said play option response indicia row being oriented radially with respect to said back disk center.

2. The blackjack play option response indicator of claim 1, wherein said preselected number is four; and wherein said plurality of player's cards value indicia comprises thirty-five player's cards value indicia.

3. The blackjack play option response indicator of claim 2, wherein said dealer's up card value indicia comprise ten dealer's up card values ranging from ace through 10, wherein said predetermined pattern comprises said ten dealer's up card values being arranged in numerical sequence in a mutually spaced apart relationship adjacent said back disk periphery.

4. The blackjack play option response indicator of claim 1, wherein said player's cards value indicia rows comprise:

a first player's cards value indicia row comprising player's cards value indicia indicating at least one ace;

a second player's cards value indicia row comprising player's cards value indicia indicating paired card values;

a third player's cards value indicia row comprising player's cards value indicia indicating total player's cards values ranging substantially between 13 and 20; and a fourth player's cards value indicia row comprising player's cards value indicia indicating total player's cards values ranging substantially between 5 and 12;

wherein each of said first, second, third and fourth player's cards value indicia rows are arranged in sequentially decreasing value from said front disk center toward said front disk periphery.

5. The blackjack play option response indicator of claim 4, wherein said alignment indicia comprise a respective alignment indicia for each of said first, second, third and fourth player's cards value indicia rows, wherein when the alignment indicia of a respective one of said first, second, third and fourth player's cards value indicia rows is aligned with a selected one of said dealer's up card value indicia, preselected play option response indicia appear in said view port means laterally adjacent each player's cards value indicia of the selected one of the first, second, third and fourth player's cards value indicia row, which appearance thereby indicates to a user a predetermined play option response appropriate to each player's cards value indicia of the selected one of the first, second, third and fourth player's cards value indicia row.

6. The blackjack play option response indicator of claim 5, wherein said play option response indicia are arranged in forty play option response indicia rows comprising ten sets of four play option response indicia rows, each said set being centered with respect to each dealer's up card value indicia, respectively; wherein each play option row of each said set respectively corresponds to each player's cards value indicia now, and wherein when a selected alignment indicia is aligned with a selected dealer's up card value indicia, a predetermined play option response indicia row aligns with said view port means laterally adjacent a selected player's cards value indicia row that corresponds to the selected alignment indicia.

7. The blackjack play option response indicator of claim 6, wherein said plurality of play option response indicia comprise 350 predetermined play option response indicia.

8. The blackjack play option response indicator of claim 7, further comprising dealer up card value indicia positioning indicia on said back disk face centrally with respect to each said dealer up card value indicia for providing a positional alignment indication therefor with respect to each said alignment indicia.

9. The blackjack play option response indicator of claim 8, wherein said view port means comprises:

a first slot formed in said front disk laterally adjacent said first player's card value indicia row;

a second slot formed in said front disk laterally adjacent said second player's card value indicia row;

a third slot formed in said front disk laterally adjacent said third player's card value indicia row; and a fourth slot formed in said front disk laterally adjacent said fourth player's card value indicia row.

10. The blackjack play option response indicator of claim 9, wherein said plurality of play option responses are selectively color coded.

11. A blackjack play option response indicator, comprising:

a front disk having a front disk face, a front disk center and a front disk periphery, said front disk having a plurality of player's cards value indicia placed in a predetermined arrangement and a predetermined sequence on said front disk face, said front disk having view port means for seeing through said front disk adjacent each player's cards value indicia, said front disk having alignment indicia on said front disk face substantially adjacent said periphery thereof, said alignment indicia being selectively associated with said player's cards value indicia, wherein said player's cards value indicia comprise thirty-five player's cards value indicia arranged in four rows comprising.

a first player's cards value indicia row comprising player's cards value indicia indicating at least one ace;

a second player's cards value indicia row comprising player's cards value indicia indicating paired card values;

a third player's cards value indicia row comprising player's cards value indicia indicating total player's cards values ranging substantially between 13 and 20; and a fourth player's cards value indicia row comprising player's cards value indicia indicating total player's cards values ranging substantially between 5 and 12;

wherein each of said first, second, third and fourth player's cards value indicia rows are arranged in sequentially decreasing value from said front disk center toward said front disk periphery;

a rear disk having a rear disk face, a rear disk center and a rear disk periphery, said rear disk being superposed said front disk wherein said rear disk face faces toward said front disk and said front disk face faces away from said rear disk, said rear disk having a plurality of play option response indicia arranged in a predetermined arrangement and a predetermined sequence on said rear disk face for selectively appearing in said view port means in said front disk, said rear disk having dealer's up card value indicia arranged in a predetermined pattern on said rear disk face substantially adjacent said rear disk periphery, wherein said dealer's up card value indicia comprise ten dealer's up card values ranging from ace through 10, wherein said predetermined pattern comprises said ten dealer's up card values being arranged in numerical sequence in a mutually spaced apart relationship adjacent said back disk periphery; and means for rotatably interconnecting said front disk center with said rear disk center;

wherein each said first, second, third and fourth player's cards value indicia row is oriented radially with respect to said front disk center;

wherein said view port means comprises:

a first slot formed in said front disk laterally adjacent said first player's card value indicia row;

a second slot formed in said front disk laterally adjacent said second player's card value indicia row;

a third slot formed in said front disk laterally adjacent said third player's card value indicia row; and a fourth slot formed in said front disk laterally adjacent said fourth player's card value indicia row;

wherein said plurality of play option response indicia are arranged in said preselected number of play option response indicia rows with respect to each said dealer's up card value indicia, each said play option response indicia row being oriented radially with respect to said back disk center; and wherein a user who is playing a game of blackjack locates a player's cards value indicia corresponding to card values of a hand held by the user, rotates a selected alignment indicia associated therewith into alignment with a dealer's up card value indicia corresponding to an up card value held by a dealer who is dealing the game of blackjack, then reads the play option response indicia through said view port means adjacent the selected player's cards value indicia to thereby ascertain what appropriate play option is to be played by the user.

12. The blackjack play option response indicator of claim 11, wherein said alignment indicia comprise a respective alignment indicia for each of said first, second, third and fourth player's cards value indicia rows, wherein when the alignment indicia of a respective one of said first, second, third and fourth player's cards value indicia rows is aligned with a selected one of said dealer's up card value indicia, preselected play option response indicia appear in said view port means laterally adjacent each player's cards value indicia of the selected one of the first, second, third and fourth player's cards value indicia row, which appearance thereby indicates to a user a predetermined play option response appropriate to each player's cards value indicia of the selected one of the first, second, third and fourth player's cards value indicia row.

13. The blackjack play option response indicator of claim 12, wherein said play option response indicia are arranged in forty play option response indicia rows comprising ten sets of four play option response indicia rows, each said set being centered with respect to each dealer's up card value indicia, respectively; wherein each play option response indicia row of each said set respectively corresponds to each player's cards value indicia row; and wherein when a selected alignment indicia is aligned with a selected dealer's up card value indicia, a predetermined play option response indicia row aligns with said view port means laterally adjacent a selected player's cards value indicia row that corresponds to the selected alignment indicia.

14. The blackjack play option response indicator of claim 13, wherein said plurality of play option response indicia comprise 350 predetermined play option response indicia.

15. The blackjack play option response indicator of claim 14, wherein said front disk periphery defines a first cross-section of said front disk, wherein said back disk periphery defines a second cross-section of said back disk, wherein said second cross-section is greater than said first cross-section so that said dealer's up card value indicia is not covered by said front disk.

16. The blackjack play option response indicator of claim 15, further comprising dealer up card value indicia positioning indicia on said back disk face centrally with respect to each said dealer up card value indicia for providing a positional alignment indication therefor with respect to each said alignment indicia.

17. The blackjack play option response indicator of claim 16, wherein said plurality of play option responses are selectively color coded.

* * * * *